US009989194B2

(12) United States Patent
Marinus et al.

(10) Patent No.: US 9,989,194 B2
(45) Date of Patent: Jun. 5, 2018

(54) LIGHTING DEVICE

(71) Applicant: PHILIPS LIGHTING HOLDING B.V., Eindhoven (NL)

(72) Inventors: Antonius Adrianus Maria Marinus, Eindhoven (NL); Coen Theodorus Hubertus Fransiscus Liedenbaum, Oss (NL); Hendrik Jan Eggink, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days. days.

(21) Appl. No.: 14/889,035

(22) PCT Filed: Apr. 28, 2014

(86) PCT No.: PCT/EP2014/058562
§ 371 (c)(1),
(2) Date: Nov. 4, 2015

(87) PCT Pub. No.: WO2014/180689
PCT Pub. Date: Nov. 13, 2014

(65) Prior Publication Data

US 2016/0116117 A1 Apr. 28, 2016

(30) Foreign Application Priority Data

May 8, 2013 (EP) ..... 13167058

(51) Int. Cl.
*F21V 29/00* (2015.01)
*F21K 99/00* (2016.01)
(Continued)

(52) U.S. Cl.
CPC ..... *F21K 9/135* (2013.01); *F21K 9/23* (2016.08); *F21K 9/232* (2016.08); *F21K 9/61* (2016.08);
(Continued)

(58) Field of Classification Search
CPC . F21K 9/135; F21K 9/23; F21K 9/232; F21K 9/61; F21V 29/503; F21V 29/506;
(Continued)

(56) References Cited

U.S. PATENT DOCUMENTS 7,387,403 B2 * 6/2008 Mighetto ..... F21V 19/003 362/218
8,454,185 B2 * 6/2013 Hua ..... F21S 6/005 313/46
(Continued)

FOREIGN PATENT DOCUMENTS

CN 102147068 A 8/2011
EP 2138761 A1 12/2009
(Continued)

*Primary Examiner* — Peggy Neils
(74) *Attorney, Agent, or Firm* — Akarsh P. Belagodu

(57) ABSTRACT

There is provided a lighting device (10) which is suitable for a retrofit LED lamp, and which comprises an envelope (15) surrounding an inner volume (16), of which envelope an outer surface (12*a*) is arranged for distributing light from a multiple of light sources (19) of the lighting device. An inner surface (12*b*) of the envelope is utilized for providing a low thermal resistance of the lighting device on a system level by being at least partly covered by a sheet metal element (13). Driver electronics (17) of the light sources are arranged within the inner volume.

13 Claims, 7 Drawing Sheets

(51) Int. Cl.

| | |
|---|---|
| ***F21V 3/04*** | (2018.01) |
| ***F21V 29/89*** | (2015.01) |
| ***F21V 29/70*** | (2015.01) |
| ***F21K 9/23*** | (2016.01) |
| ***F21K 9/232*** | (2016.01) |
| ***F21K 9/61*** | (2016.01) |
| *F21V 29/505* | (2015.01) |
| *F21V 29/506* | (2015.01) |
| *F21Y 115/10* | (2016.01) |
| *F21Y 107/30* | (2016.01) |

(52) U.S. Cl.
CPC ..... *F21V 3/04* (2013.01); *F21V 29/70* (2015.01); *F21V 29/89* (2015.01); *F21V 29/006* (2013.01); *F21V 29/505* (2015.01); *F21V 29/506* (2015.01); *F21Y 2107/30* (2016.08); *F21Y 2115/10* (2016.08)

(58) Field of Classification Search
CPC .. F21V 29/70; F21Y 2101/00; F21Y 2107/30; F21Y 2115/10
See application file for complete search history.

(56) References Cited

U.S. PATENT DOCUMENTS

| | | | | |
|---|---|---|---|---|
| 8,487,518 | B2 * | 7/2013 | Johnston | G02B 6/0085 313/11 |
| 8,723,424 | B2 * | 5/2014 | Dassanayake | F21V 3/049 315/112 |
| 8,761,565 | B1 * | 6/2014 | Coleman | F21V 5/002 362/335 |
| 8,820,966 | B2 * | 9/2014 | Igaki | F21V 3/02 362/249.04 |
| 8,827,504 | B2 * | 9/2014 | Parker | F21V 3/02 362/249.14 |
| 8,926,130 | B2 * | 1/2015 | Li | F21V 29/2231 362/249.02 |
| 8,926,131 | B2 * | 1/2015 | Johnston | F21V 17/005 362/249.02 |
| 9,028,129 | B2 * | 5/2015 | McCollum | F21V 29/77 362/628 |
| 9,175,813 | B2 * | 11/2015 | DeVore | H01J 5/54 |
| 2007/0091643 | A1 | 4/2007 | Ogawa | |
| 2010/0314985 | A1 * | 12/2010 | Premysler | F21V 29/402 313/46 |
| 2011/0032708 | A1 | 2/2011 | Johnston et al. | |
| 2011/0101861 | A1 | 5/2011 | Yoo | |
| 2011/0109215 | A1 | 5/2011 | Choi et al. | |
| 2011/0215345 | A1 | 9/2011 | Tarsa et al. | |
| 2011/0309735 | A1 | 12/2011 | Parker et al. | |
| 2012/0025705 | A1 * | 2/2012 | Chang | F21V 3/02 315/32 |
| 2012/0051038 | A1 | 3/2012 | Yue et al. | |
| 2012/0281405 | A1 * | 11/2012 | Roth | F21S 8/088 362/244 |
| 2013/0077285 | A1 | 3/2013 | Isogai et al. | |
| 2013/0301273 | A1 * | 11/2013 | Chu | F21V 29/70 362/294 |
| 2014/0321112 | A1 * | 10/2014 | Huang | F21V 17/06 362/230 |

FOREIGN PATENT DOCUMENTS

| | | | |
|---|---|---|---|
| EP | 2236912 | A2 | 10/2010 |
| EP | 2392953 | A2 | 7/2011 |
| JP | 2007194132 | A | 8/2007 |
| JP | 2010015754 | A | 1/2010 |
| JP | 2010108768 | A | 5/2010 |
| KR | 20100110045 | A | 10/2010 |
| WO | 2012132895 | A1 | 10/2012 |
| WO | 2013007815 | A1 | 1/2013 |

* cited by examiner

LIGHTING DEVICE

CROSS-REFERENCE TO PRIOR APPLICATIONS

This application is the U.S. National Phase application under 35 U.S.C. § 371 of International Application No. PCT/EP2014/058562, filed on Apr. 28, 2014, which claims the benefit of European Patent Application No. 13167058.0, filed on May 8, 2013. These applications are hereby incorporated by reference herein.

FIELD OF THE INVENTION

The present invention relates generally to a lighting device, and more particularly to a solid state lighting device comprising a multiple of light sources, an envelope and a heat spreader element arranged at the envelope.

BACKGROUND OF THE INVENTION

Lighting devices such as light emitting diode (LED) based light bulbs, or LED lamps, are generally known. A LED lamp concept for a high intensity, high lumen output, is typically limited by its thermal properties and available space for the driver electronics. US 2012/0139403 A1 discloses a solid state lighting device comprising LEDs optically coupled to an optical guide, which optical guide encloses an inner volume, and a thermal guide. The thermal guide is integrated within the optical guide for providing thermal conduction from the LEDs and is either co-extensively proximate to an area of the optical guide or is arranged within the inner volume of the optical guide.

The system described above is generally effective in accomplishing a thermally effective lighting device. However, there is a need for a less complex, less costly lighting device with efficient thermal properties.

SUMMARY OF THE INVENTION

It is an object of the present invention to at least provide an improved lighting device. It would be advantageous to achieve a lighting device suitable for a retrofit LED lamp at low cost, which has a low thermal resistance, $R_{th}$, on system level. It would also be desirable to enable a lighting device which has a high available volume for the driver electronics, and to provide a good optical performance with the possibility of an omni-directional light distribution. These objects are achieved by a lighting device according to the present invention as defined in the appended independent claim. Preferred embodiments are set forth in the dependent claims and in the following description and drawings.

Thus, in accordance with the present inventive concept, there is provided a lighting device comprising a light source, an envelope comprising an outer surface arranged for distributing light from the multiple of light sources, and an inner surface being configured for surrounding an internal volume. The inner surface is at least partly covered by a sheet metal element, i.e. a heat spreader element arranged at the inner surface. The sheet metal element is separated a predetermined distance from said inner surface, thereby providing a clearance between the inner surface and the sheet metal element, which is advantageous for preventing optical coupling between the sheet metal element and the envelope.

This provides a low cost lighting device which utilizes the inner surface of the envelope to provide a large cooling area.

The inner volume of the envelope may then be utilized for positioning of driver electronics of the lighting device. Since the light output from the lighting device is generated at the outer surface of the envelope, advantageously no shadows from the driver electronics or the heat spreader element will be present in the generated light. Sheet metals are generally cheap and flexible, and are further associated with easy shaping and forming technologies, which is advantageous.

According to an embodiment of the lighting device, a portion of the sheet metal element is arranged in direct contact with the inner surface or be thermally connected with the inner surface for instance by means of some thermal coupling agent. Further, at least a portion of the sheet metal element is separated a predetermined distance from the inner surface. Preferably, the predetermined distance is selected between 10 μm and 200 μm, and is typically selected to about 100 μm, to ensure good thermal properties of the lighting device. In an exemplifying embodiment, spacer elements are arranged between the sheet metal element and the inner surface for providing the predetermined distance.

According to an embodiment of the lighting device each of the multiple of light sources is thermally coupled to the sheet metal element to increase the heat transfer from the light sources to the sheet metal element. For LED's with a thermal pad: soldering or applying advanced glue is applicable for thermally coupling the LED's to the sheet metal element. For LED's mounted on a flexible sheet metal element (flex foil) a properly designed flex foil and an adhesive layer, e.g. a LED strip in the Equinox, is applicable for providing a good thermal coupling between the LEDs and the sheet metal element.

The outer surface of the envelope is according to an embodiment of the lighting device arranged with light extraction elements in order to enhance the light output and/or to control the intensity profile or light ray extraction from the outer surface of the envelope.

According to embodiments of the lighting device, the multiple light sources are distributed over a preselected area of the envelope, for instance at the inner surface of, or alternatively on the outer surface of, the envelope. Clusters of light sources may be arranged at selected surface areas. Thereby, the light distribution from the envelope may for instance be evenly spread all over the respective surface, i.e. the light sources are evenly distributed over the entire envelope, or the light distribution is concentrated to specific areas of the envelope. Providing clusters of LEDs (or LEDs) distributed over the surface of the envelope, and thereby the surface of the sheet metal element, is advantageous to provide an improved thermal spreading by means of the sheet metal element. As a consequence, the material of the sheet metal element can be selected to be thinner or less thermally conducting, which opens the possibility to use materials like thin steel sheets.

According to an embodiment of the lighting device, the envelope comprises a light guide which is optically coupled to the multiple of light sources for receiving and distributing light from the light sources. The light is distributed through the light guide by means of internal reflection. In this embodiment, to realize good internal reflection in the light guide, the sheet metal element is preferably separated a predetermined distance from the light guide as previously mentioned. In an embodiment of the lighting device, the light guide is provided with a light input edge at an end surface at its proximal end, and at which the multiple light sources are arranged. The light guide may be arranged as a hollow solid light guide, or be flexible. When being flexible, the light guide is preferably arranged utilizing an outer protective transparent encapsulation layer of the envelope as a support structure.

According to an embodiment of the lighting device, driver electronics of the multiple of light sources is arranged within the internal volume. Thereby, a considerably larger volume is utilized for driver electronics than in known retrofit LED lamps solution, where the driver electronics is typically arranged within the light bulb base. Also, with the arrangement of the present invention, the required volume for driver electronics is not interfering with the surface for light output coupling and light source cooling of the lighting device. When the lighting device is utilized to provide a retrofit lamp, it typically comprises a base coupled to the envelope, which may be an Edison screw base or any other applicable base.

These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

The present invention will now be described more fully hereinafter with reference to the accompanying drawings. The below embodiments are provided by way of example so that this disclosure will be thorough and complete, and will fully convey the scope of the invention to those skilled in the art. Like numbers refer to like elements throughout.

Figure 1A:
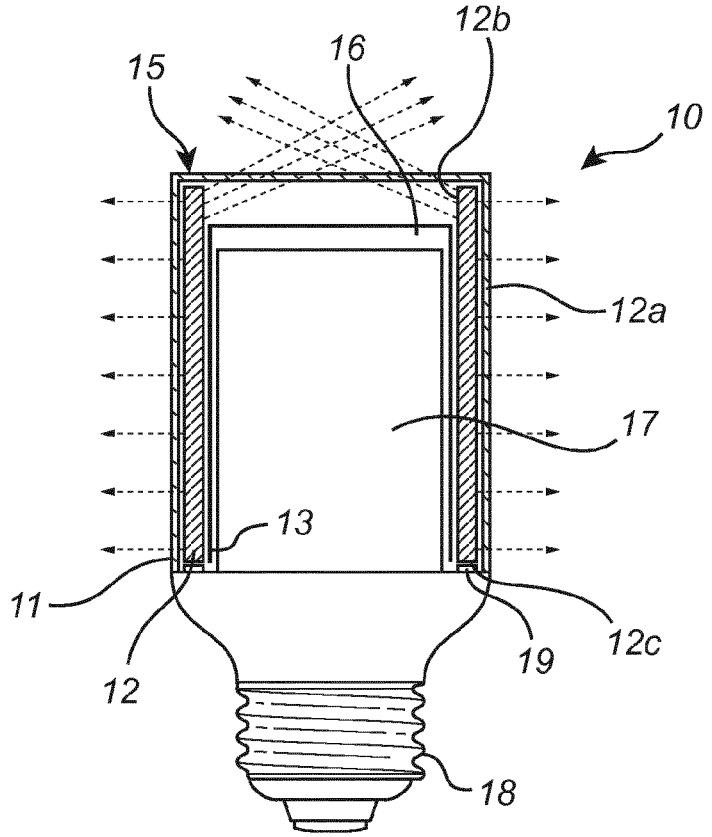
FIG. 1*a* is a schematic partly cut open cross sectional side view of an embodiment of a lighting device according to the present invention.
Figure 1B:
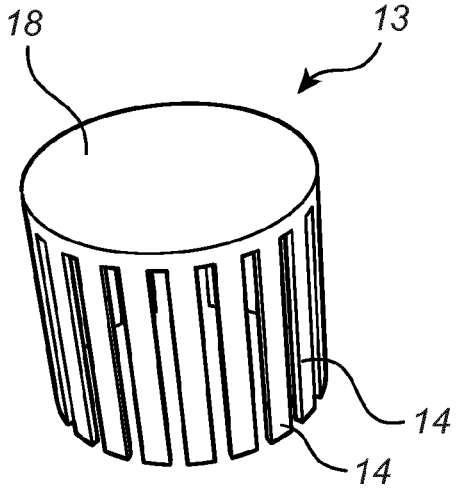
FIGS. 1*b* and 1*c* are schematic perspective side views of heat spreaders of two embodiments of the lighting device according to the present invention.

FIG. 1*a* is a schematic partly cut open cross sectional side view of an embodiment of a lighting device 10, here a retro fit light bulb, comprising an envelope 15 which encloses/or surrounds an internal volume 16. The envelope 15 is engaged with a base 18, which here is implemented with an Edison base for use with a conventional light bulb socket. The base 18 is configured to connect a power supply to driving circuitry 17 arranged to drive the light source 19 of the lighting device 10. The envelope 15 comprises a transparent encapsulation layer 11, e.g. from glass, and a light guide 12, here a solid hollow cylinder shaped body with a nominally constant radius along its length. The light guide is arranged on the inner side of the transparent encapsulation layer 11, and covers a large part it. A heat spreader, here a 200 μm thick sheet metal element 13 made of Copper is closely situated against the inner surface of the light guide 12 in order to realize a good thermal contact. A perspective view of the sheet metal element 13 is shown in FIG. 1*b*. The sheet metal element 13 is substantially shaped as a cylinder which is closed on its lateral end 18, and which is provided with a multiple of tongues 14. This exemplifying sheet metal element is advantageous in that it provides a simple realization of a shaped body. Because of the spring function of the multiple of tongues 14 it provides a simple way to deal with dimensional tolerances etc. within the envelope, and is provides easy mounting of the sheet metal element into the envelope.

Figure 1C:
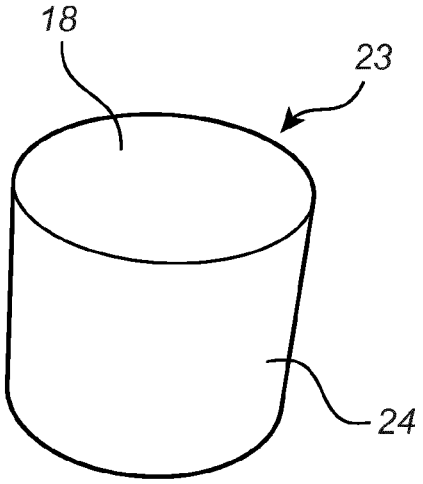

A sheet metal element 23 is in an alternative embodiment of the lighting device, and as illustrated in FIG. 1*c*, substantially shaped as a cylinder which is closed on its lateral side 18, and which is provided with a sidewall 24 without the multiple of tongues 14, as illustrated for the sheet metal element 13 in FIG. 1*b*.

Referring again to FIG. 1*a*, in this embodiment the light source 19 comprises multiple light sources that are arranged at a light input edge 12*c* of the light guide 12 at its proximal end. Optionally, the solid-state light sources 19 are positioned in respective openings defined in the light guide, e.g. slots arranged in the proximal end thereof. The multiple light sources 19 are preferably LEDs. The multiple of light sources are arranged such that light from the light sources 19 enters the light input edge 12*c* at the proximal end of the light guide 12 and travels in the light guide by means of total internal reflection. The light sources 19 are preferably arranged in a ring, as is shown in the lighting device 20 as illustrated in FIG. 2*a*, or another suitable pattern depending on the shape of the light input edge of the light guide to which the light sources are optically coupled.

According to an embodiment of the lighting device according to the present inventive concept, the outer surface of the light guide, compare surface 12*a* in FIG. 1*a*, is provided with light extracting elements (not shown) to enhance and control the intensity profile, i.e. the variation of intensity of the light output from the light guide. The light extracting elements are preferably arranged in defined areas of the outer surface of the light guide. The light extracting elements are configured to extract light from the light guide with a predetermined light ray angle distribution and/or intensity profile. Light ray angle distribution refers to the variation of intensity with ray angle (typically a solid angle) of light emitted from a light emitter such as the light guide. In some embodiments, the light extracting elements at a given defined area are provided by means of protrusions or indentations, or a mixture thereof, arranged on/in the outer surface.

Figure 2A:
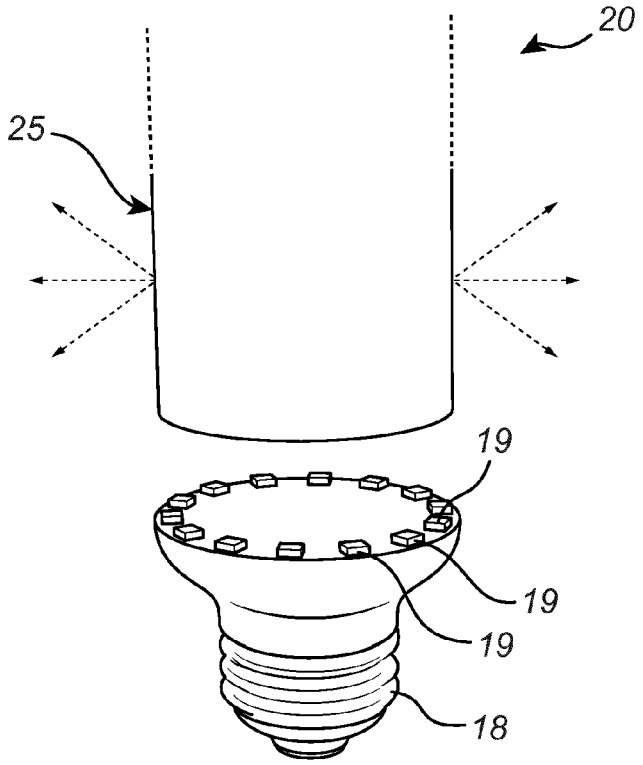
FIG. 2*a* is a schematic perspective exploded side view illustration of an embodiment of a lighting device according to the present invention.
Figure 2B:
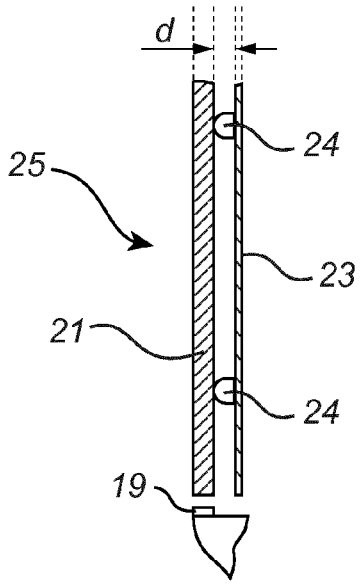
FIGS. 2*b*-2*d* show close up cross sectional views of a wall of envelopes of embodiments of the lighting device according to the present invention.

Referring now to FIG. 2*a*, the lighting device 20 comprises an envelope 35 enclosing an internal volume in which the driver electronics of the light sources 19 is arranged. FIG. 2*b* is a close up cross sectional view showing the envelope 25 in more detail. The envelope 35 comprises a light guide 21 to which light sources 19 are optically coupled. A sheet metal element 23 is arranged at the inner side of the light guide 21 and is arranged at a predetermined distance d 24 of 100 μm with respect to the light guide 21.

Figure 2C:
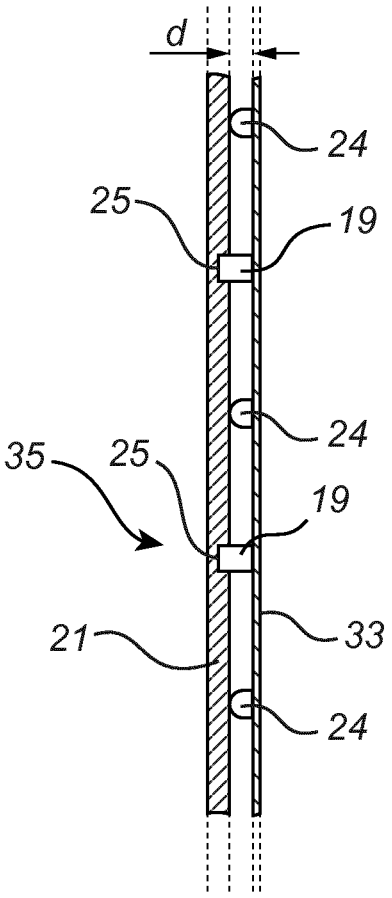

In an alternative embodiment, which is illustrated in FIG. 2*c*, the envelope 35 has a similar arrangement as described with reference to FIG. 2*b*. However, here light sources 19 are distributed with respect to the surface of the sheet metal element 33/inner surface of the light guide 21. Each light source 19 is thermally coupled to the sheet metal element 19. In this example, the thermal coupling is provided by direct contact, or by means of a thermal coupling agent, such as thermally conductive adhesive, thermal grease, thermal contact pads, etc. applied between light sources 19 and the sheet metal element 33. Alternatively, thermal coupling is provided by means of some heat conducting element, like a heat pipe, to convey heat produced by the solid-state light source to the sheet metal element. The light sources 19 may be inserted in cavities 25 arranged in the inner surface of the light guide 21 as illustrated in FIG. 2*c*, or alternatively the light sources may be inserted in holes extending through the light guide between the major inner and outer surfaces thereof, compare for instance with the lighting device 30 in FIG. 3 where the light sources extend through an envelope comprising a plastic enclosure via a through hole and lens arrangement. In an alternative embodiment the sheet metal element is highly reflective and directly engaged with the light guide.

Figure 2D:
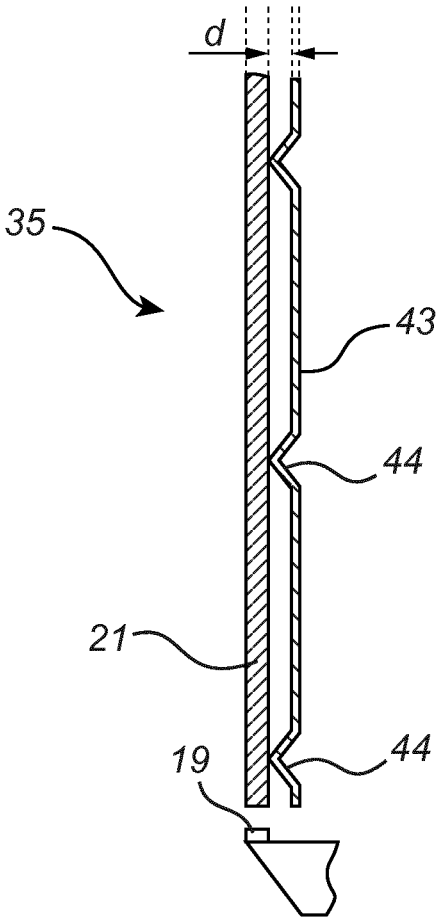

Reference is now made to FIG. 2*d*, which is a schematic illustration of an embodiment of the invention. In the shown embodiment, the configuration of the envelope 35 has a similar arrangement as in the embodiments described with reference to FIG. 2*b* and FIG. 2*c*. However, here a sheet metal element 43 with integrated spacer elements 44 is utilized. The spacer elements 44 are used to form a clearance, i.e. a predetermined distance d, or a gap, between the sheet metal element 43 and the light guide 21. Advantageously, the clearance prevents optical coupling between the light guide 21 and the metal sheet element 43. The integrated spacer elements 44 further provide a good thermal coupling between the sheet metal element 43 and the light guide 21. The spacer elements 44 are here realized by small protrusions in the sheet metal element, and which are distributed over the surface thereof. In the illustrated example each protrusion is shaped having a pointed tip to provide a small contact area between the spacer element 44 and the light guide 21 which is preferred.

Figure 3A:
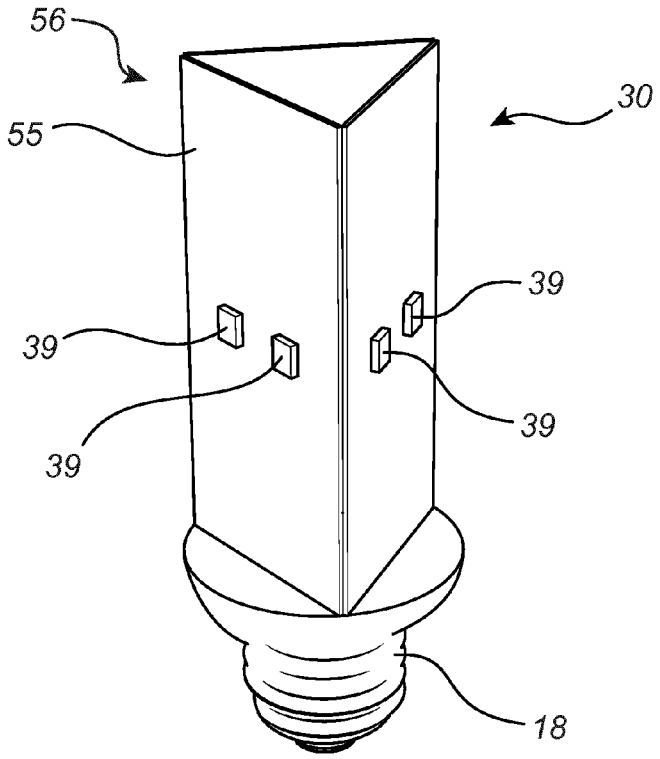
FIG. 3*a* is a schematic perspective side view of an embodiment of a lighting device according to the present invention.
Figure 3B:
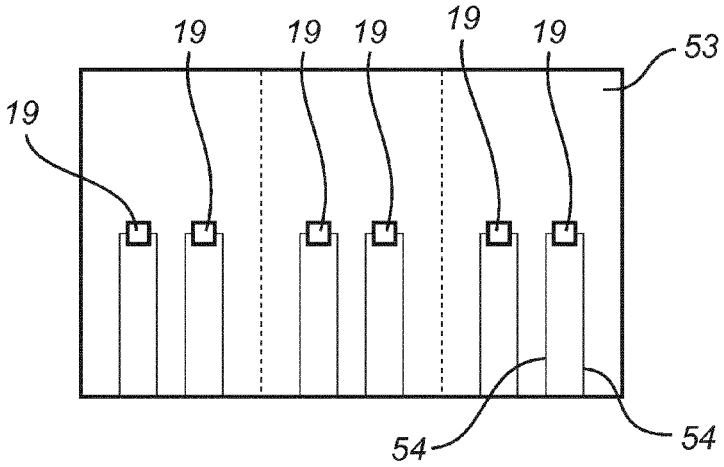
FIG. 3*b* is a schematic illustration of a part of an envelope of a lighting device according to an embodiment of the present invention, same embodiment of a lighting device as partly illustrated in FIG. 3*a*.
Figure 3C:
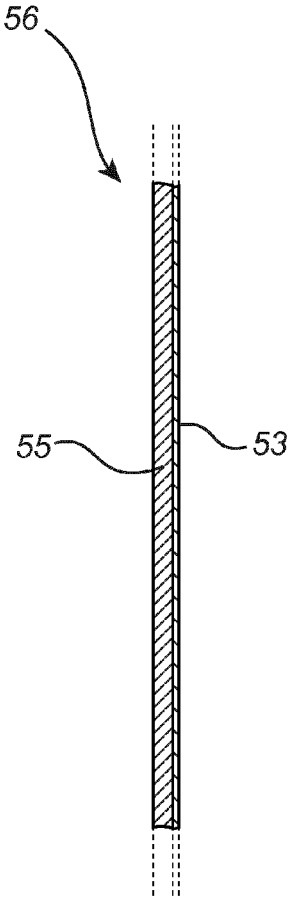
FIG. 3*c* shows a schematic cross sectional view of the envelope of the lighting device of FIG. 3*a;*

FIG. 3*a* schematically illustrates a lighting device 30 according to the invention, where the envelope comprises a plastic enclosure 55, having a triangular cross section in the horizontal plane, and which encloses an inner volume. At an inner side of the plastic enclosure 55, a folded printed cardboard (PCB) is arranged. The unfolded printed PCB is illustrated in a schematic top view in FIG. 3*b*. Two fold lines are indicated with dotted lines along which fold lines the PCB is folded before mounting into the plastic enclosure 55. A sheet metal element 53 is arranged on the PCB. Further, clusters of light sources, LEDs 19, are mounted onto the PCB. During manufacturing the LEDs 19 are mounted onto the foldable PCB (with required electrical insulation) and connected via electrical wires 54 to driver electronics which when mounted is situated in the inner space/volume which is formed as the foldable PCB is folded to a triangular shape (driver electronics is not visible in the figures). The folded PCB is then mounted into the envelope, which comprises the plastic enclosure 55. In an alternative embodiment, the plastic enclosure 55 comprises sub portions which are assembled onto the foldable PCB. At positions of the plastic enclosure 55 which correspond to the positions of the LEDs 19 on the folded PCB, through holes and lenses 39 are arranged, such that the LEDs can extend through the through holes (not visible) in the plastic enclosure, and reach lenses 39 arranged to cover the holes on the outer surface of the plastic enclosure 55. As is illustrated in the close up cross sectional view in FIG. 3*c*, the sheet metal element 53 is arranged to directly engage with the plastic enclosure 55, such that an envelope 56 arranged for distributing light from said multiple of light sources, e.g. LEDs in the lenses 39 is formed. The inner surface of the envelope 56 is at least partly covered by a sheet metal element 53, as the PCB and the plastic enclosure are assembled.

Figure 4:
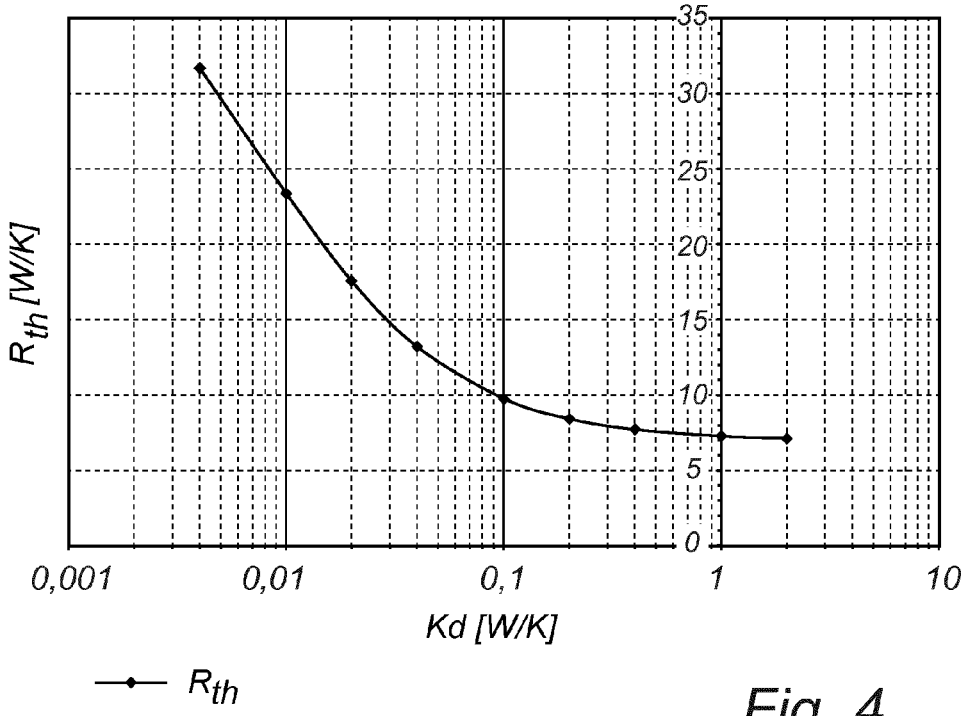
FIG. 4 is a graph illustrating the thermal resistance of LED area to ambient.

According to embodiments of the lighting device, since the thermal performance of the lighting device is determined by a parameter governed by thermal conductivity times thickness, Kd, of the sheet metal, the thickness of the sheet metal element is selected with respect to the specific sheet metal material, see a graph of a simulation illustrating the thermal resistance $R_{th}$ from LED area (area where light sources are arranged) to ambient as a function of the value Kd of the heat spreader element, in FIG. 4. For an A60 standardized bulb shape with the light sources (LEDs) arranged in the neck region of the bulb a value of 0.1 W/K or higher is close to a minimum thermal resistance. For a lighting device according to the present inventive concept, a value of 0.1 W/K is achievable with 250 μm copper, 500 μm aluminum or 2 mm steel.

Figure 5A:
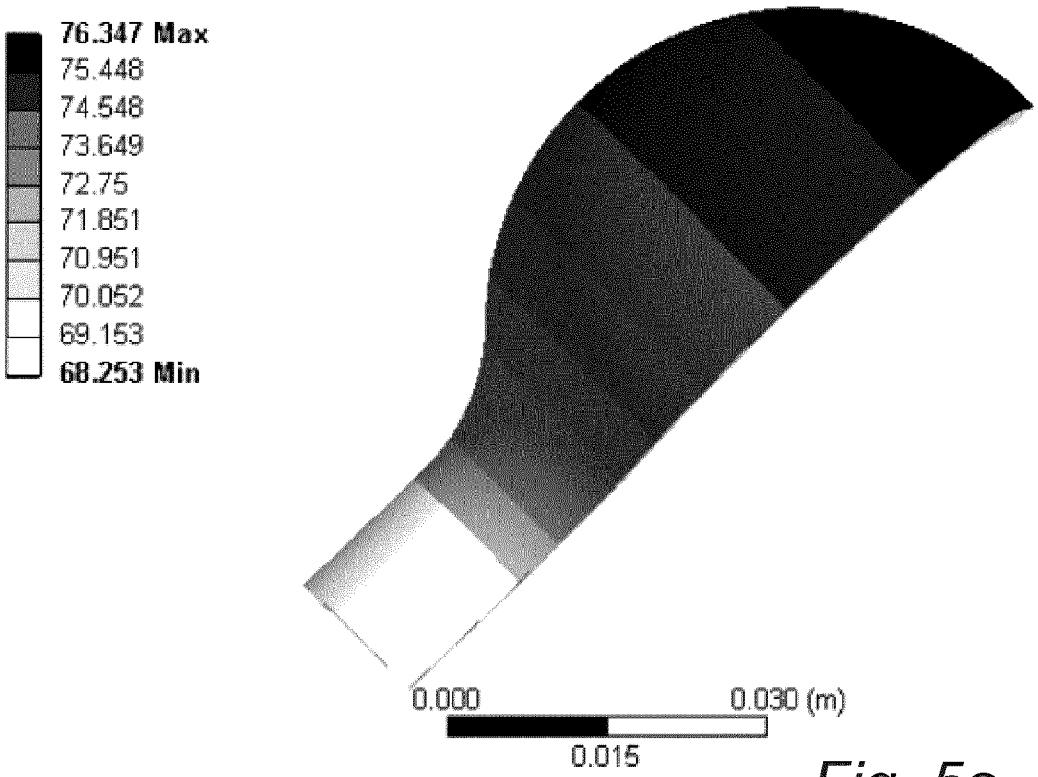
FIG. 5 and FIG. 6 illustrate thermal simulations of the temperature distribution over the lighting device for embodiments of the lighting device according to the present invention.
Figure 5B:
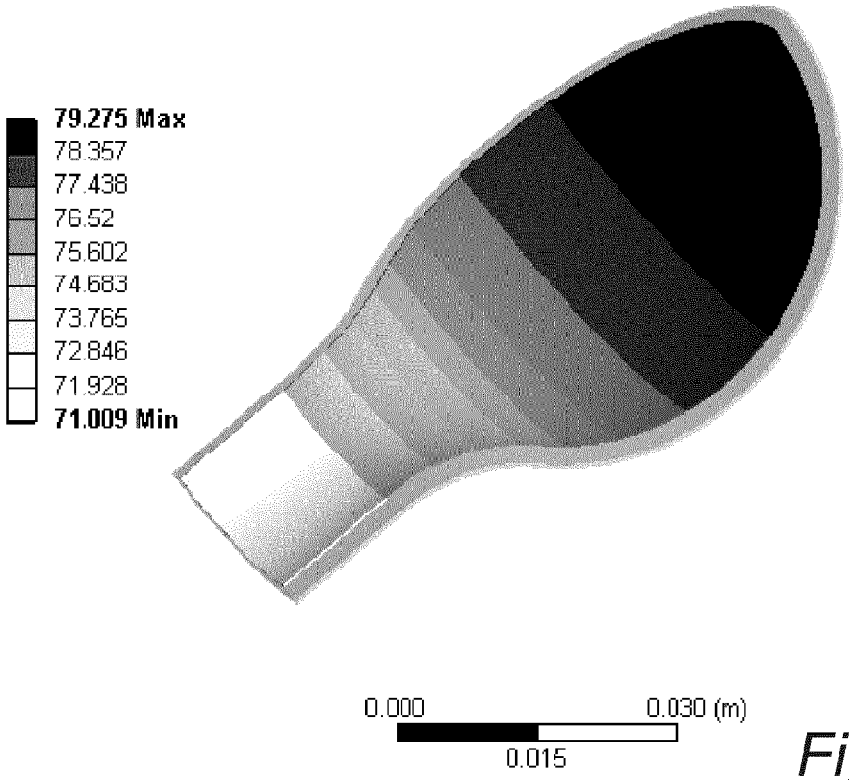
Figure 6A:
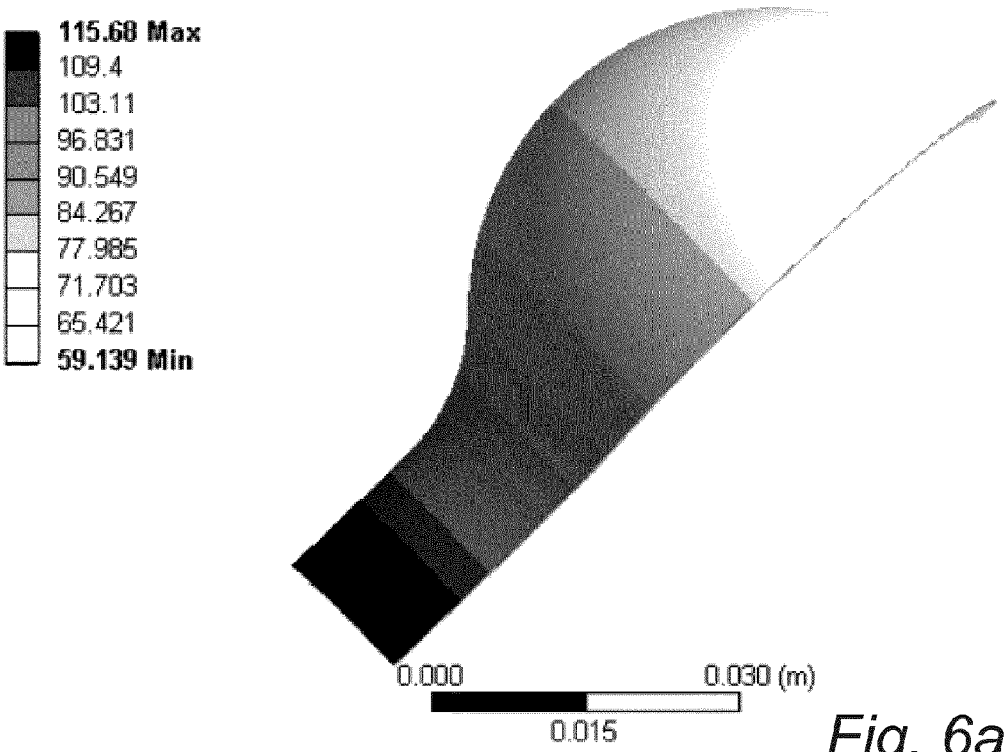
Figure 6B:
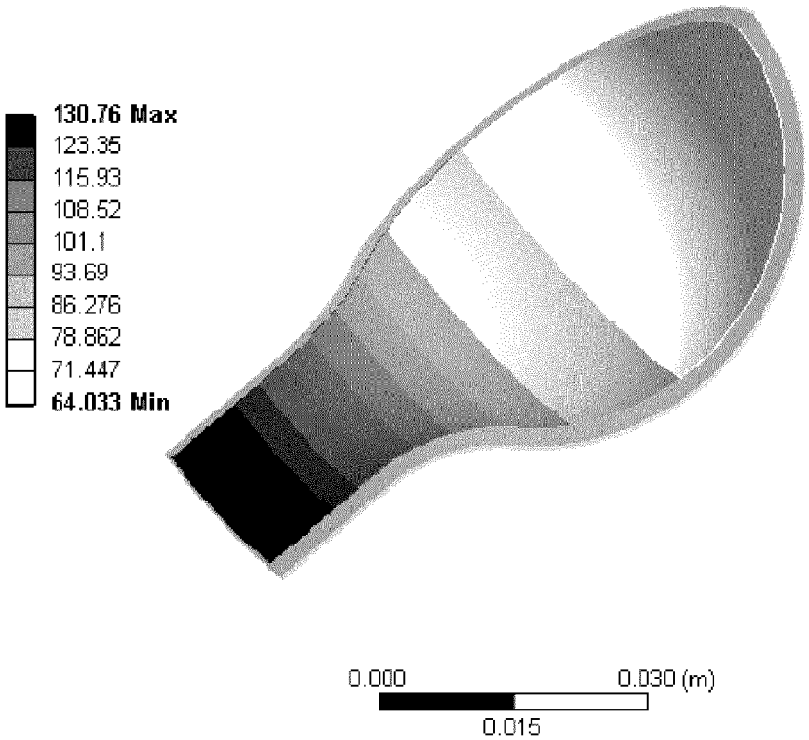

With reference now to FIG. 5 and FIG. 6, thermal simulations of an A60 standardized glass bulb with a similar basic construction as the exemplifying embodiment of the present inventive concept as shown in FIG. 1*a* are presented. The heat spreader element 13 is an aluminum sheet metal. In the simulations, the thickness of the glass bulb, corresponding to the encapsulation layer 11 in FIG. 1*a*, is 0.5 mm, the light guide 12 thickness is 2 mm, and the heat spreader element thickness is 0.2 mm. The temperature distribution of the lighting device according to two extreme situations at free burning, base up, and ambient temperature 25° C. are simulated:

in the first extreme situation, a heat load of 8 W is fully distributed over the bulb inner surface, shown in FIGS. 5*a* and 5*b*, and in the second extreme situation, a heat load of 8 W is applied at the ring area of the neck of the glass bulb, shown in FIGS. 6*a* and 6*b*. Here the sheet metal element KD is 0.04 W/K.

As can be seen in FIG. 5*a*, which illustrates the temperature distribution of the glass bulb outer surface, for a uniform distribution of the heat load over the inner wall of the glass bulb, the glass bulb surface reaches a maximum temperature of 76° C. at a top portion thereof, and a minimum temperature of 68° C. at the glass bulb surface at the neck of the glass bulb. The temperature distribution on the inner surface of the glass bulb, i.e. at the sheet metal element, is illustrated in FIG. 5*b*, and reaches a maximum temperature of 79° C. at a top portion thereof, and a minimum temperature of 71° C. at the glass bulb inner surface at the neck of the glass bulb.

To continue with reference to FIG. 6*a*, which illustrates the temperature distribution of the glass bulb outer surface, for a distribution of the heat load at the neck of the glass bulb, the glass bulb surface reaches a maximum temperature of 116° C. at the glass bulb surface at the neck of the glass bulb, and a minimum temperature of 59° C. at a top portion thereof. The temperature distribution on the sheet metal element surface of the glass bulb, is illustrated in FIG. 6*b*, and reaches a maximum temperature of 131° C. at the glass bulb inner surface at the neck of the glass bulb, and a minimum temperature of 64° C. at a top portion thereof. In this simulation, the sheet metal is present, but the heat load is not distributed and the heat load is thus concentrated on a small ring in the neck region. This is a worst case situation, while the best case situation is the fully distributed heat load (corresponding to distributed light sources) as shown in FIGS. 5*a* and 5*b*.

Examples of solid state light sources applicable for lighting devices according to the invention include light emitting diodes (LEDs), laser diodes, and organic LEDs (OLEDs).

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A lighting device, comprising:

a light source;

an envelope comprising an outer surface arranged for distributing light from said light source, and an inner surface being configured for surrounding an internal volume;

wherein said inner surface is at least partly covered by a sheet metal element having a first lateral end that is closed and a second lateral end, opposite the first lateral end, that is open, and wherein said sheet metal element is separated a predetermined distance from said inner surface thereby providing a clearance between said inner surface and said sheet metal element, said predetermined distance being provided by spacer elements arranged between said sheet metal element and said inner surface, wherein said inner surface is parallel to the sheet metal element along said predetermined distance, and wherein driver electronics of the light source is arranged within said internal volume.

2. The lighting device according to claim 1, wherein a portion of said sheet metal element is arranged in thermal contact with said inner surface.

3. The lighting device according to claim 1, wherein said predetermined distance is selected between 10 μm and 200 μm.

4. The lighting device according to claim 1, wherein the light source comprises multiple light sources.

5. The lighting device according to claim 4, wherein the light sources are each thermally coupled to said sheet metal element.

6. The lighting device according to claim 1, wherein said outer surface of said envelope is arranged with light extraction elements.

7. The lighting device according to claim 4, wherein the light sources are distributed over a preselected area of said envelope.

8. The lighting device according to claim 4, wherein said envelope comprises a light guide which is optically coupled to the light sources for receiving and distributing light from the light sources.

9. The lighting device according to claim 8, wherein said light guide at an end surface at its proximal end is provided with a light input edge at which the light sources are arranged.

10. The lighting device according to claim 8, wherein said light guide is flexible.

11. The lighting device according to claim 1, further comprising a base coupled to said envelope.

12. The lighting device according to claim 11, wherein said base is an Edison screw base.

13. A lighting device, comprising:

one or more light sources;

an envelope comprising an outer surface arranged for distributing light from said one or more light sources, and an inner surface being configured for surrounding an internal volume;

wherein said inner surface is at least partly covered by a sheet metal element having a first lateral end that is closed and a second lateral end, opposite the first lateral end, that is open, and wherein said sheet metal element is separated a predetermined distance from said inner surface thereby providing a clearance between said inner surface and said sheet metal element, said predetermined distance being provided by spacer elements arranged between said sheet metal element and said inner surface, wherein at least one light source of the one or more light sources is arranged in a cavity arranged in the inner surface of the envelope, wherein said inner surface is parallel to the sheet metal element along said predetermined distance, and wherein driver electronics of the light source is arranged within said internal volume.

* * * * *